US010152904B2

(12) United States Patent
Zeng et al.

(10) Patent No.: US 10,152,904 B2
(45) Date of Patent: Dec. 11, 2018

(54) LED STRIP LIGHT FOR SHELF SIGNBOARDS

(71) Applicants: Self Electronics Co., Ltd., Ningbo, Zhejiang (CN); Wanjiong Lin, Ningbo, Zhejiang (CN); Self electronics USA Corporation, Norcross, GA (US)

(72) Inventors: Guoqing Zeng, Zhejiang (CN); Yuanfang Xue, Zhejiang (CN); Jianguo Dong, Zhejiang (CN); Kai Xu, Zhejiang (CN); Fawei Zhang, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 0 days.

(21) Appl. No.: 15/832,404

(22) Filed: Dec. 5, 2017

(65) Prior Publication Data

US 2018/0182267 A1 Jun. 28, 2018

(30) Foreign Application Priority Data

Dec. 22, 2016 (CN) ..... 2016 1 1194963

(51) Int. Cl.
*G09F 13/18* (2006.01)
*A47F 3/00* (2006.01)
(Continued)

(52) U.S. Cl.
CPC ..... *G09F 13/18* (2013.01); *A47F 3/001* (2013.01); *A47F 11/10* (2013.01); *F21S 4/20* (2016.01);
(Continued)

(58) Field of Classification Search
CPC ..... G09F 13/18; G09F 2013/222; F21S 4/28
See application file for complete search history.

(56) References Cited

U.S. PATENT DOCUMENTS 9,410,682 B1 * 8/2016 Wang ..... A47F 5/0068
2010/0195317 A1 * 8/2010 Oketani ..... A47F 3/001 362/125

(Continued)

*Primary Examiner* — Gary C Hoge
(74) *Attorney, Agent, or Firm* — Wang Law Firm, Inc.

(57) ABSTRACT

An LED strip light for shelf signboards, comprises a strip-shaped lamp chamber, and an LED light-emitting module. The strip-shaped lamp chamber comprises a card board connecting edge, a non-transparent edge, an upper transparent edge and a lower transparent edge. The LED light-emitting module comprises at least one LED chip, and a strip-shaped lens. The strip-shaped lens includes an incident surface, a first fully reflecting surface, a second fully reflecting surface, a refractably reflecting surface. The first fully reflecting surface reflects all the incident lights thereon toward the upper light transparent edge. The second fully reflecting surface reflects all the incident lights thereon toward the refractably reflecting surface. And the outgoing light of the refractably reflecting surface is directed toward the lower transparent edge. The LED strip light for shelf signboards allows the display side placed on the board to be illuminated so as to improve the user's desire to shop, and to illuminate the boundary between the laminates and the column, and it can improve user experience and save energy and reduce costs.

9 Claims, 4 Drawing Sheets

(51) Int. Cl.

| | |
|---|---|
| ***A47F 11/10*** | (2006.01) |
| ***F21V 33/00*** | (2006.01) |
| ***F21V 5/00*** | (2018.01) |
| ***F21V 5/04*** | (2006.01) |
| ***F21V 7/00*** | (2006.01) |
| ***F21S 4/20*** | (2016.01) |
| ***F21S 4/28*** | (2016.01) |
| *F21W 131/305* | (2006.01) |
| *F21W 131/405* | (2006.01) |
| *F21Y 115/10* | (2016.01) |
| *G09F 13/22* | (2006.01) |

(52) U.S. Cl.

CPC ..... *F21S 4/28* (2016.01); *F21V 5/007* (2013.01); *F21V 5/04* (2013.01); *F21V 7/0091* (2013.01); *F21V 33/0012* (2013.01); *A47B 2220/0077* (2013.01); *F21W 2131/305* (2013.01); *F21W 2131/405* (2013.01); *F21Y 2115/10* (2016.08); *G09F 2013/222* (2013.01)

(56) References Cited

U.S. PATENT DOCUMENTS

| | | | | |
|---|---|---|---|---|
| 2011/0044030 | A1* | 2/2011 | Pichel | A47F 11/10 362/125 |
| 2014/0313710 | A1* | 10/2014 | Wessel | F21V 21/088 362/217.14 |
| 2015/0070928 | A1* | 3/2015 | Rau | G09F 13/18 362/604 |
| 2016/0377257 | A1* | 12/2016 | Xu | F21V 5/08 362/224 |
| 2016/0377258 | A1* | 12/2016 | Xu | F21V 5/04 362/223 |
| 2017/0153010 | A1* | 6/2017 | Waalkes | F21V 21/005 |

* cited by examiner

LED STRIP LIGHT FOR SHELF SIGNBOARDS

RELATED APPLICATION

This present application claims benefit of the Chinese Application, CN 201611194963.5, filed on Dec. 22, 2016.

TECHNICAL FIELD

The present invention relates to lighting apparatus, with particular emphasis on an LED strip light for shelf signboards.

BACKGROUND OF THE INVENTION

In ordinary daily life, all kinds of lighting apparatus can be seen everywhere, such as fluorescent lamps, street lamps, table lamps, artistic lamps and so on. In the above-described lighting apparatus, the tungsten bulb is traditionally used as a light-emitting light source. In recent years, due to the ever-changing technology, light-emitting diode (LED) has been used as a light source. Moreover, in addition to lighting apparatus, for the general traffic signs, billboards, headlight etc., light-emitting diode (LED) has also been used as a light source. The light-emitting diode (LED) as a light source has the advantages of energy-saving and greater brightness. Therefore, it has been gradually common.

With the popularity of LED lamps, more and more occasions began to use LED strip light. For the increasingly common use of LED strip light, its installation has become the focus of attention. For supermarkets, shopping malls, museums, exhibition halls and other places, they need to use a large number of shelves to display the items, these shelves include at least two columns, arms erected in the column, and at least one laminate placed in the two arms. In actual use, the shelf will commonly set at least two laminates. The lighting between these laminates is generally from two directions of the light source, one is from the top of the light source of the buildings, such as supermarkets, shopping malls and so on, and another is from the underlying light source of each laminate. However, when the goods are placed on the laminates, the display side of the goods nearest the user can not always be highlighted, the light of the display side is the same as the light obtained from the other sides. It is difficult to enhance the user's desire to buy. And the side of the laminate near the column is often blocked by the laminate, so it is relatively dark, which will reduce the customer's lighting experience, and if lamps are also installed on the side of the laminate near the column, it will increase costs and waste energy.

Therefore, it is necessary to provide an LED strip light for shelf signboards which can make the items on the laminate get accent illumination and also fill light in the space below the laminate and the LED strip light for shelf signboards can meet the above requirements.

BRIEF SUMMARY OF THE INVENTION

An LED strip light for shelf signboards, the shelf comprising at least one laminate which comprises one card board for setting the LED strip light for shelf signboards, characterized in that comprising a strip-shaped lamp chamber and an LED light-emitting module disposed within the strip-shaped lamp chamber, on a cross-section perpendicular to the direction in which the strip-shaped lamp chamber extends, the strip-shaped lamp chamber comprising a card board connecting edge for connecting the card board, a non-transparent edge spaced from the card board connecting edge, an upper transparent edge connecting the card board connecting edge and the non-transparent edge, a lower transparent edge connecting the card board connecting edge and the non-transparent edge and spaced from the upper transparent edge, the upper transparent edge being parallel to the laminate, the length of the card board connecting edge being less than that of the non-transparent edge, the LED light-emitting module which is provided on the card board connecting edge comprising at least one LED chip and a strip lens arranged the direction in which the light emitted from the LED chip, on a cross-section perpendicular to the direction in which the strip-shaped lamp chamber extends the strip lens comprising an incident surface, a first fully reflecting surface, a second fully reflecting surface, a refractably reflecting surface connected to the second fully reflecting surface and a boundary line between the first fully reflecting surface and the second fully reflecting surface, the first fully reflecting surface reflecting all the incident light thereon toward the upper transparent edge, the second fully reflecting surface reflecting all the incident light thereon toward the refractably reflecting surface, the refractably reflecting surface refracting the light from the incident surface and reflecting the light from the second fully reflecting surface, the light emitted from the refractably reflecting surface being directed toward the lower transparent edge, and the boundary line intersecting the optical axis of the LED chip.

Further, the optical axis of the LED chip is parallel to the upper transparent edge.

Further, the card board connecting edge is arranged in parallel to the non-transparent edge.

Further, the LED strip light for shelf signboards further comprises an optical diffusion film disposed in the strip-shaped lamp chamber, and the optical diffusion film is provided between the upper transparent edge and the LED light-emitting module.

Further, the LED light emitting module further comprises a circuit board for setting the LED chip, and two L-Shaped slots are provided on the card board connecting edge for inserting the circuit board and the strip lens is fixed to the circuit board.

Further, the strip lens comprises a first light exit surface, the reflected light of the first fully reflecting surface is emitted from the first light exit surface, and the first light exit surface is perpendicular to the incident surface.

Further, the strip lens comprises a second light exit surface, and the reflected light from the refractably reflecting surface is emitted from the second light exit surface, and the second light exit surface is parallel or coincident to the incident surface, the connection position of the second light exit surface and the incident surface is flush with the connection position of the lower transparent edge and the card board connecting edge.

Further, the LED light emitting module further comprises a mounting assembly provided on the strip lens, and the mounting assembly is provided on the incident surface of the strip lens.

Further, the mounting assembly comprises two assembly bars extending from the incident surface of the stripe lens, two slots arranged in the two assembly bars and a finger bar respectively provided on the outside of the two assembly bars.

Compared with the prior art, since the LED strip light for shelf signboards in the present invention has the structure of the strip-shaped lamp chamber and the optical design structure of the strip lens of the LED light-emitting module, the display side of the goods nearest the user can be highlighted, which can enhance the user's desire to buy and light up the junction of the laminate and the column. In that premise that no lamps are added, it will enhance the customer's lighting experience, and increase costs and waste energy.

BRIEF DESCRIPTION OF THE DRAWINGS

The drawings described herein are intended to promote a further understanding of the present invention, as follows.

DETAILED DESCRIPTION OF THE INVENTION

The present application is illustrated by way of the following detailed description based on of the accompanying drawings. It should be noted that illustration to the embodiment in this application is not intended to limit the invention.

Figure 1:
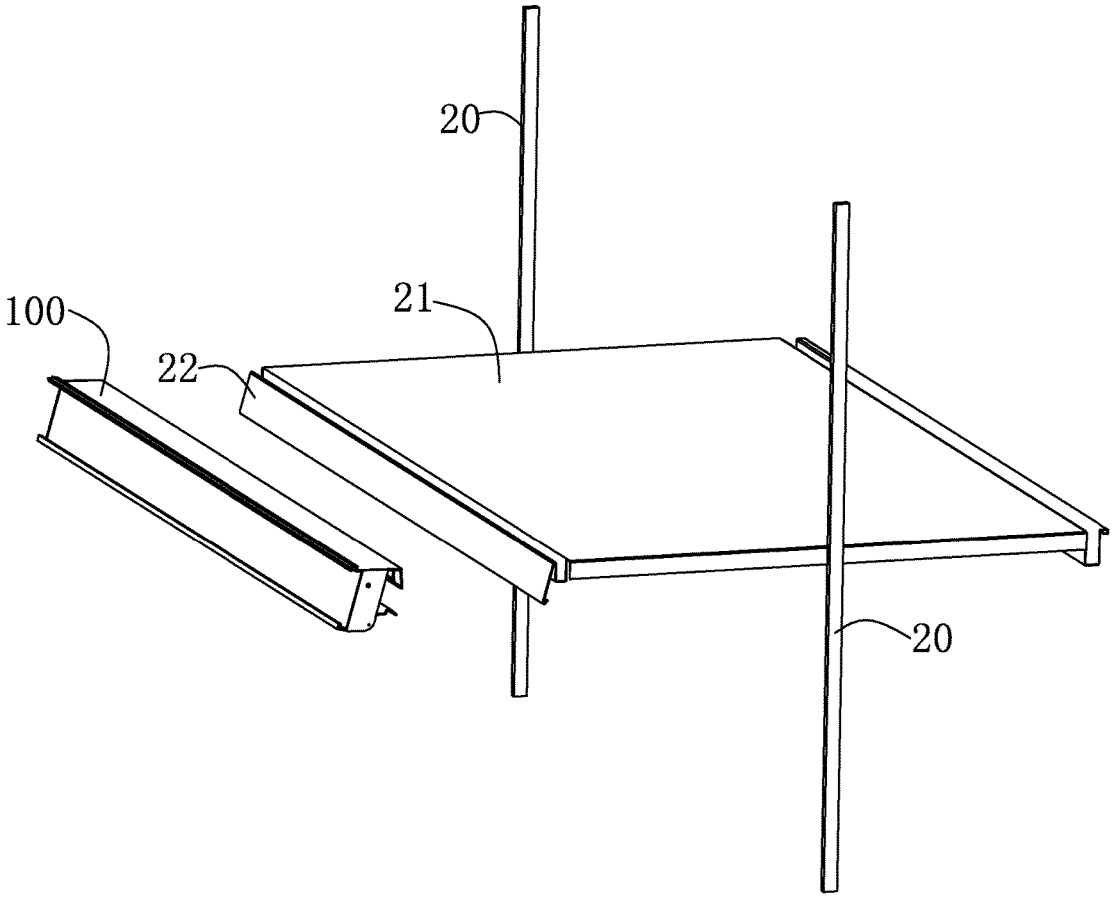
FIG. 1 is a schematic view of an exploded structure of the LED strip light for shelf signboards provided by the present invention.
Figure 2:
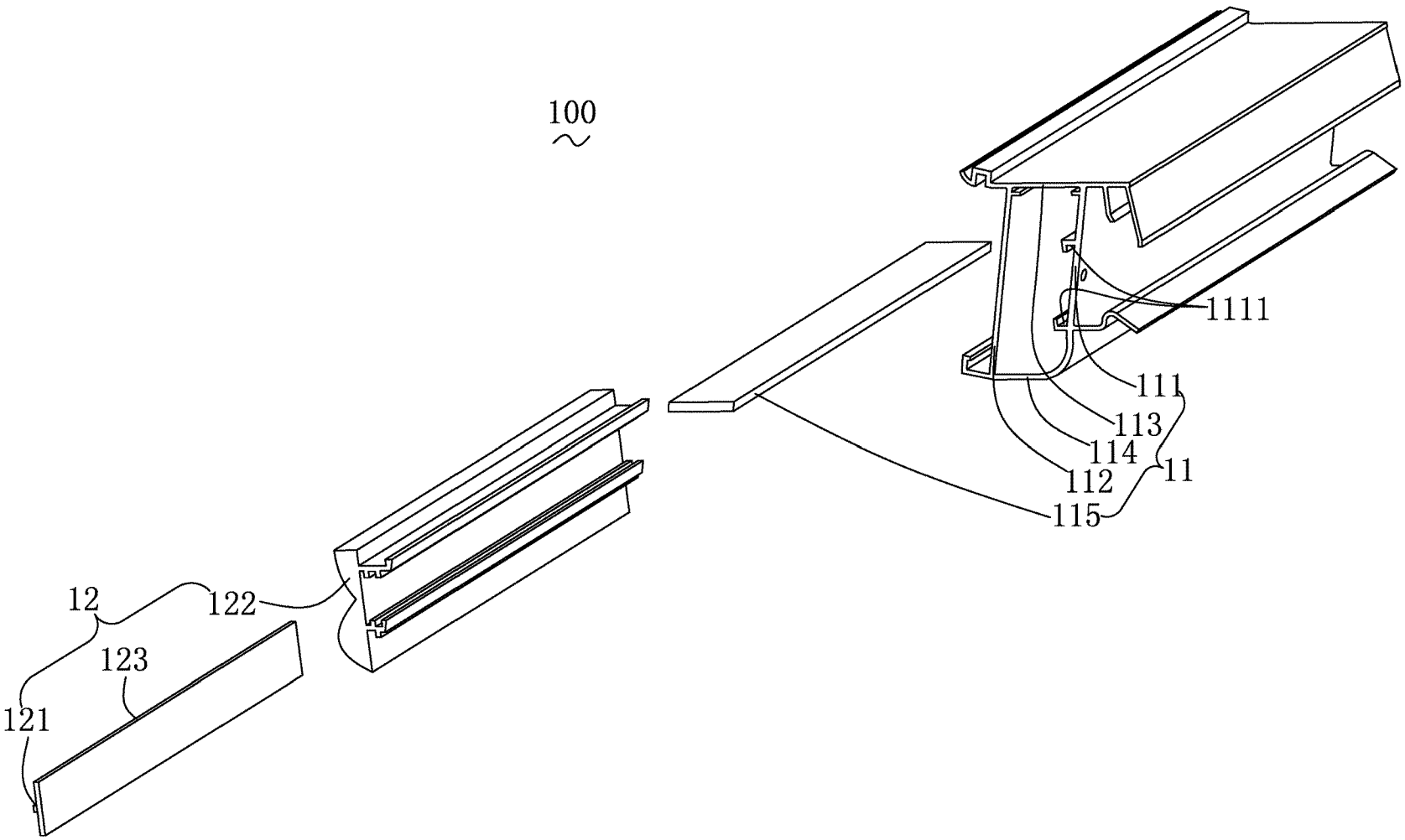
FIG. 2 is a schematic exploded view of the LED strip light for shelf signboards of FIG. 1.
Figure 3:
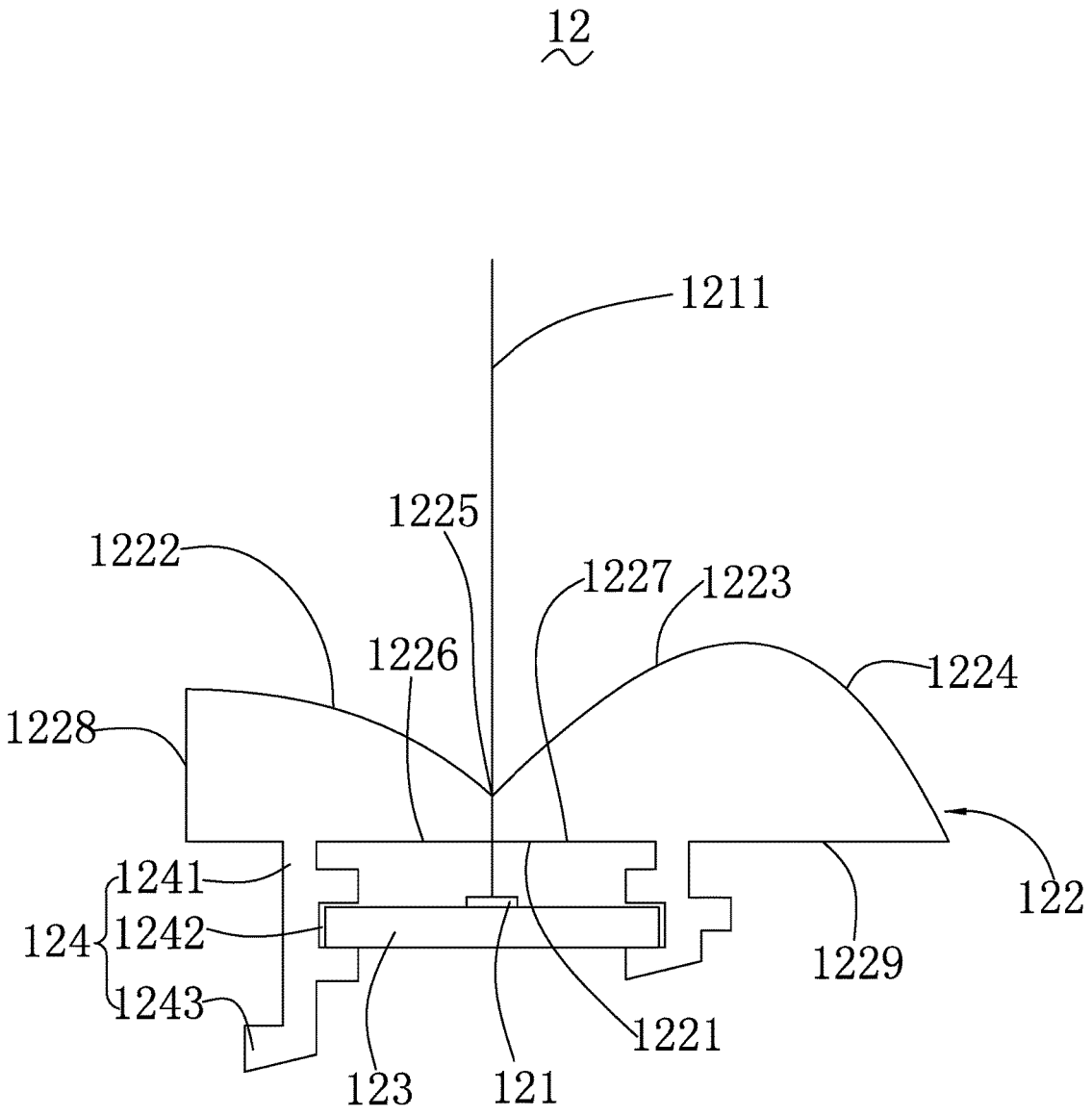
FIG. 3 is a schematic view of the structure of the LED light emitting module in the LED strip light for shelf signboards of FIG. 2.
Figure 4:
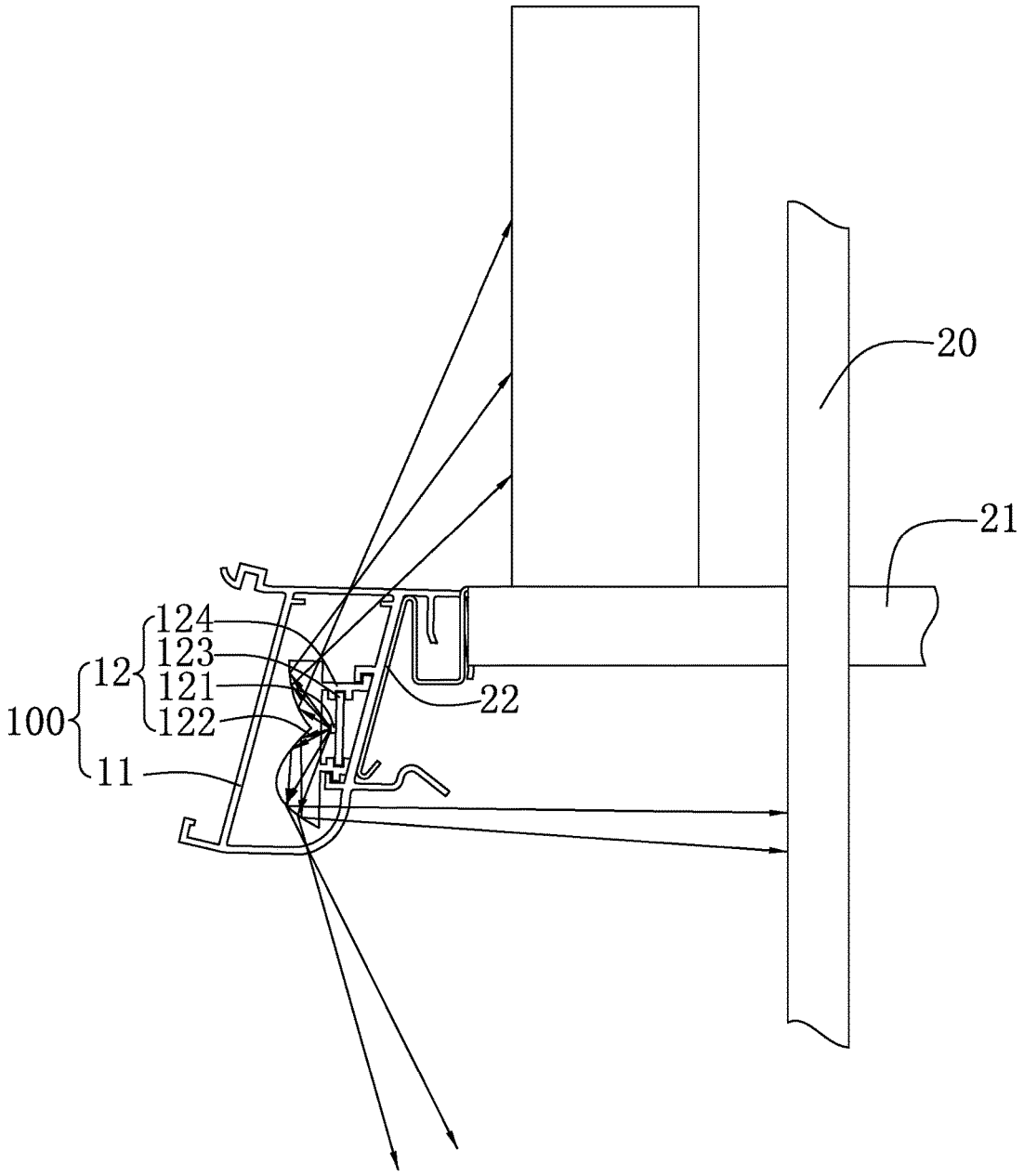
FIG. 4 is a schematic perspective view of LED strip light for shelf signboards of FIG. 1.

Referring to FIG. 1 to FIG. 4, FIG. 1 is a schematic view of an exploded structure of the LED strip light 100 for shelf signboards provided by the present invention. At first the basic structure of the shelf for the LED strip light for shelf signboards needs to be described. The shelf as a prior art, is widely used in shopping malls, supermarkets, museums and other exhibitions. Typically, the shelf comprises at least two columns 20 and at least one laminate 21 disposed on the two columns 20. Each of the laminates 21 comprises a card board 22 for setting the LED strip light 100 for shelf signboards. Meanwhile, in order to facilitate the user to view the signboards, on a cross-section perpendicular to the extending direction of the LED strip light 100 for shelf signboards, the angle between the cardboard 22 and the laminate 21 is obtuse rather than vertical. The obtuse angle can be less than 105 degrees or can also be set according to actual requirements. The LED strip light 100 for shelf signboards comprises a strip-shaped lamp chamber 11 and an LED light-emitting module 12 disposed within the strip-shaped lamp chamber. It is also to be noted that the LED strip light 100 for shelf signboards also further comprises a signboard plug assembly (not shown) for inserting signboards and a buckle assembly (not shown) used for the LED strip light 100 for shelf signboards which can be mounted on the card board 22. The strip-shaped lamp chamber 11 is provided between the signboard plug assembly and the buckle assembly. It is contemplated that the LED strip light 100 for shelf signboards also comprises other functional modules such as end caps, drive power and the like. The above-mentioned functional modules are not intended to be the focus of the present invention and will not be described in detail herein.

On the cross-section perpendicular to the direction in which the strip-shaped lamp chamber extends 11, the strip-shaped lamp chamber 11 comprises a card board connecting edge 111 for connecting the card board 22, a non-transparent edge 112 spaced from the card board connecting edge 111, an upper transparent edge 113 connecting the card board connecting edge 111 and the non-transparent edge 112, a lower transparent edge 114 connecting the card board connecting edge 111 and the non-transparent edge 112 and spaced from the upper transparent edge 113, the card board connecting edge 111 is used for connecting the card board 22, i.e., the strip-shaped lamp chamber 11 is provided on the card board 22. The shape of the card board connecting edge 111 should be the same as that of the card board 22 so that the card board connecting edge 111 can be attached to the card board 22. In the present embodiment, the card board 22 is a flat plate, so the card board connecting edge 111 is also a flat plate. When the card board 22 is wavy or corrugated, the card board connecting edge 111 should be formed in a wavy shape or a corrugated shape. And two L-shaped slots 1111 are provided on one side of the card board connecting edge 111 towards the inside of the strip-shaped lamp chamber 11. The two L-shaped slots 1111 are provided for setting the LED light-emitting module 12, and the structure thereof will be described in detail below. The non-transparent edge 112 is also used to set up the signboard plug assembly. The non-transparent side 112 is parallel to the card board connecting edge 111 so as to facilitate the user to view the signboards. The length of the non-transparent edge 112 is greater than the length of the card board connecting edge 111. The angle between the side of the upper transparent edge 113 towards the outside of the strip-shaped lamp chamber 11 and the laminate 21 is 180 degrees so that the side of the upper transparent edge 113 towards the outside of the strip-shaped lamp chamber 11 is parallel to the laminate 21, and it will be beautiful. Also because the side of the upper transparent edge 113 towards the outside of the strip-shaped lamp chamber 11 is parallel to the laminate 21, the sides of the non-transparent edge 112 and the card board connecting edge 111 located on the upper transparent edge 113 are flush, while the sides of the non-transparent edge 112 and the card board connecting edge 111 located on the lower transparent edge 114 are staggered. Since the sides of the non-transparent edge 112 and the card board connecting edge 111 located on the lower transparent edge 114 are staggered, the overall shape of the lower transparent edge 114 is not parallel to the laminate 21. The lower transparent edge 114 can be an arcuate, L-shaped structure or hypotenuse which connects the end of the non-transparent edge 112 and the card board connecting edge 111. In the present embodiment, the lower transparent edge 114 is an arcuate. Due to the presence of the arcuate lower transparent edge 114, the light can be emitted from the lower transparent edge 114 and emitted to the articles placed on the next laminate 21 or illuminate the internal space between the two laminates 21.

The LED light-emitting module 12 comprises at least one LED chip 121, a strip lens 122 arranged in the direction in which the light emitted from the LED chip 121, a circuit board 123 for setting the LED chip 121, and a mounting assembly 124 arranged on the strip lens 122. The LED chip 121 is a light-emitting diode known to those skilled in the art, and the specific structure and working principle thereof will not be described here. It can be understood that each LED chip 121 comprises an optical axis 1211. Although the optical axis 1211 or the optical axis surface is a virtual geometric feature, it is essential as an optical design guide. The optical axis 1211 is generally located at the center of the LED chip 121 or the optical axis surface is on the symmetry line of the LED chip 121. Meanwhile, in the present embodiment, the optical axis 1211 is parallel to the upper transparent edge 113 to facilitate the optical design. On a cross-section perpendicular to the direction in which the strip-shaped lamp chamber extends 11 the strip lens 122 comprises an incident surface 1221, a first fully reflecting surface 1222, a second fully reflecting surface 1223, a refractably reflecting surface 1224 connected to the second fully reflecting surface 1223 and a boundary line 1225 between the first fully reflecting surface 1222 and the second fully reflecting surface 1223. The incident surface 1221 is used for receiving the light emitted from the LED chip 121, and in order to simplify the optical design, the incident surface 1221 is generally a plane, whose distance from the LED chip 121 is determined by the light spot size the incident surface 1221 requires. In the limiting case, the incident surface 1221 clings to the LED chip 121. In the present embodiment, the incident surface 1221 is spaced from the LED chip 121. The boundary line 1225 intersects the optical axis 1211 so that half of the amount of light of the LED chip 121 enters one side of the boundary line 1225 and the other half enters the other side of the boundary line 1225. For clarity, one side of the boundary line 1225 is defined as a first incident side 1226, and the other side of the boundary line 1225 is defined as a second incident side 1227.

The optical path principle of the strip lens 122 will be described below. The first fully reflecting surface 1222 will receive the incident light from the first incident side 1226 and reflects it to the upper transparent edge 113. So the strip lens 122 further comprises a first light exit surface 1228, the reflected light of the first fully reflecting surface 1222 is emitted from the first light exit surface 1228, and is directed toward the upper transparent edge 113. The first light exit surface 1228 is perpendicular to the incident surface 1221 to facilitate optical design. Since the emergent light from the LED chip 121 is dispersed between 0 and 180 degrees on the cross section perpendicular to the direction in which the strip-shaped lamp chamber extends 11, when the LED chip 121 is spaced from the incident surface 1221, the angle between the incident light and the incident surface 1221 of the first incident side 1226 is within 90 degrees. Then, according to the reflection principle, the angle between the light emitted from the first fully reflecting surface 1222 and the optical axis 1211 is also within 90 degrees, so that part of the light emitted from the first fully reflecting surface 1222, such as the emergent light having an angle of 30 to 80 with respect to the optical axis 1211, can illuminate the display side of the row of articles placed on the laminate 21 nearest the user and the pattern and the character on the article display side can be illuminated to achieve the purpose of accent illumination.

The second fully reflecting surface 1223 receives part of light from the second incident side 1227 and reflects all the light thereon toward the refractably reflecting surface 1224. The first fully reflecting surface 1222, the second fully reflecting surface 1223 and the refractably reflecting surface 1224 conform to the total reflection law, i.e., according to the total reflection law, the first fully reflecting surface 1222 and the second fully reflecting surface 1223 should reflect all the light.

The refractably reflecting surface 1224 receives reflected light from the second fully reflecting surface 1223 and incident light from the other part of the second incident side 1227, while the refractably reflecting surface 1224 reflects all the reflected light from the second fully reflecting surface 1223. The refractably reflecting surface 1224 receives the incident light from the other part of the second incident side 1227 and then refracts the incident light. The reflected light and the refracted light of the refractably reflecting surface 1224 are emitted from the lower transparent edge 114. Similarly, on the cross section perpendicular to the direction in which the strip-shaped lamp chamber extends 11, since the LED chip 122 is spaced from the incident surface 121, the angle between the incident light and the incident surface 121 of the second incident side 1227 is within 90 degrees. Part of the incident light of the second incident side 1227, such as the incident light having an angle of 90 to 60 degrees with respect to the incident surface 121, will be emitted to the second fully reflecting surface 1223, the incident light at an angle of 90 to 60 degrees will be reflected on the refractably reflecting surface 1224 by the second fully reflecting surface 1223. The refractably reflecting surface 1224 reflects the incident light at an angle of 90 to 60 degrees again, according to the total reflection principle, the acute angle between the reflected light and the incident surface 121 is still at 90 to 60 degrees, while the direction is approximately opposite, so that the light can be emitted to the position where the laminate 21 intersects the column of the shelf, and the entire space of the laminate of the shelf can be illuminated without increasing new lamps under the laminate 21, so it will save costs and reduce energy consumption. The strip lens further comprises a second light exit surface 1229, and the reflected light from the refractably reflecting surface 1224 is emitted from the second light exit surface 1229. In order to reduce the optical path variation of the incident light having an angle within 90 degrees to 60 degrees, the second light exit surface 1229 of the reflected light from the refractably reflecting surface 1224 is parallel or coincident to the incident surface 122. In the present embodiment, the second light exit surface 1229 is coincident to the incident surface 122 to reduce the production cost. The connection position of the second light exit surface 1229 and the second incident side 1227 is flush with the connection position of the lower transparent edge 114 and the card board connecting edge 111 so that the light emitted from the second light exit surface 1229 can be emitted to the position where the laminate 21 intersects the column of the shelf. Other part of the incident light of the second incident side 1227, such as the incident light having an angle of 60 degrees or less with respect to the incident surface 121, will be emitted directly to the refractably reflecting surface 1224, since only when the light within 90 degrees to 60 degrees conforms to the total reflection law, the incident light within 60 degrees will not conform to the total reflection law, so the part of the incident light will be directly refracted from the refractably reflecting surface 1224, according to the refraction principle, the angle between the emergent light refracted from the refractably reflecting surface 1224 and the incident surface will be less than 60 degrees, through the lower transparent edge 114, the emergent light will be emitted to the top or the display side of the articles placed on the other laminate 21, and further illuminate articles or the display side of the articles placed on the another laminate 21 to achieve the purpose of accent illumination.

The circuit board 123 may be a printed circuit board (PCB) on which a circuit or other electronic component such as a diode, a transistor, or the like is provided to give the LED chip 121 a current or control signal. In the present embodiment, the strip lens 122 is also fixed to the circuit board 123.

The mounting assembly 124 comprises two assembly bars 1241 extending from the incident surface of the stripe lens, two slots 1242 arranged in the two assembly bars 1241 and a finger bar 1243 respectively provided on the outside of the two assembly bars 1241. The slots 1242 are used to insert the circuit board 123 to fix the relative position of the circuit board 123. The two finger bars 1243 are respectively inserted in the L-shaped slot 1111 of the card board connecting edge 111 so as to fix the relative position of the LED light-emitting module 12.

The lamp chamber 11 may also comprise an optical diffusion film 115. The optical diffusion film 115 is located between the LED light emitting module 12 and the upper transparent edge 113. Since the LED chip 121 is provided on the circuit board 123 in a granular manner. And the bar lens 122 is transparent, so that the user can see a single point light source from the upper transparent edge 113, thereby affecting the user's photographic experience. In order to avoid such a situation, the optical diffusion film 115 is used for dispersing the light directed toward the upper transparent edge 113 to avoid the effect of the point light source as far as possible. The optical diffusion film 115 is a prior art, and its structure and working principle are not described in detail herein. Specifically, each slot (not shown) is respectively provided on the card board connecting edge 111 and the non-transparent side 112, and then the optical diffusion film 115 is inserted in the slots to achieve the aim of installing the optical diffusion film 115.

Compared with the prior art, since the LED strip light 100 for shelf signboards in the present invention has the structure of the strip-shaped lamp chamber 11 and the optical design structure of the strip lens of the LED light-emitting module 12, the display side of the goods nearest the user can be highlighted, which can enhance the user's desire to buy and light up the junction of the laminate and the column. In that premise that no lamps are added, it will enhance the customer's lighting experience, and increase costs and waste energy.

The above disclosure has been described by way of example and in terms of exemplary embodiment, and it is to be understood that the disclosure is not limited thereto. Rather, any modifications, equivalent alternatives or improvement etc. within the spirit of the invention are encompassed within the scope of the invention as set forth in the appended claims.

What is claimed is:

1. An LED strip light for shelf signboards, the shelf comprising at least one laminate which comprises one card board for setting the LED strip light for shelf signboards, characterized in that comprising:

a strip-shaped lamp chamber and an LED light-emitting module disposed within the strip-shaped lamp chamber, on a cross-section perpendicular to the direction in which the strip-shaped lamp chamber extends, the strip-shaped lamp chamber comprising: a card board connecting edge for connecting the card board, a non-transparent edge spaced from the card board connecting edge, an upper transparent edge connecting the card board connecting edge and the non-transparent edge, a lower transparent edge connecting the card board connecting edge and the non-transparent edge and spaced from the upper transparent edge, the upper transparent edge being parallel to the laminate, the length of the card board connecting edge being less than that of the non-transparent edge, the LED light-emitting module which is provided on the card board connecting edge comprising at least one LED chip and a strip lens arranged in the direction in which the light emitted from the LED chip, each LED chip comprises an optical axis, on a cross-section perpendicular to the extending direction of the strip-shaped lamp chamber the strip lens comprising an incident surface, a first fully reflecting surface, a second fully reflecting surface, a refractably reflecting surface connected to the second fully reflecting surface and a boundary line between the first fully reflecting surface and the second fully reflecting surface, the first fully reflecting surface reflecting all the incident light thereon toward the upper transparent edge, the second fully reflecting surface reflecting all the incident light thereon toward the refractably reflecting surface, the refractably reflecting surface refracting the light from the incident surface and reflecting the light from the second fully reflecting surface, the light emitted from the refractably reflecting surface being directed toward the lower transparent edge, and the boundary line intersecting the optical axis of the LED chip.

2. The LED strip light for shelf signboards as claimed in claim 1, wherein the optical axis of the LED chip is parallel to the upper transparent edge.

3. The LED strip light for shelf signboards as claimed in claim 1, wherein the card board connecting edge is arranged in parallel to the non-transparent edge.

4. The LED strip light for shelf signboards as claimed in claim 1, wherein the LED strip light for shelf signboards further comprises an optical diffusion film disposed in the strip-shaped lamp chamber, and the optical diffusion film is provided between the upper transparent edge and the LED light-emitting module.

5. The LED strip light for shelf signboards as claimed in claim 1, wherein the LED light emitting module further comprises a circuit board for setting the LED chip, and two L-Shaped slots are provided on the card board connecting edge for inserting the circuit board and the strip lens is fixed to the circuit board.

6. The LED strip light for shelf signboards as claimed in claim 1, wherein the strip lens comprises a first light exit surface, the reflected light of the first fully reflecting surface is emitted from the first light exit surface, and the first light exit surface is perpendicular to the incident surface.

7. The LED strip light for shelf signboards as claimed in claim 1, wherein the strip lens comprises a second light exit surface, and the reflected light from the refractably reflecting surface is emitted from the second light exit surface, and the second light exit surface is parallel or coincident to the incident surface, the connection position of the second light exit surface and the incident surface is flush with the connection position of the lower transparent edge and the card board connecting edge.

8. The LED strip light for shelf signboards as claimed in claim 1, wherein the LED light emitting module further comprises a mounting assembly provided on the strip lens, and the mounting assembly is provided on the incident surface of the strip lens.

9. The LED strip light for shelf signboards as claimed in claim 8, wherein the mounting assembly comprises two assembly bars extending from the incident surface of the stripe lens, two slots arranged in the two assembly bars and a finger bar respectively provided on the outside of the two assembly bars.

* * * * *